US005473296A

United States Patent [19]

Ishikawa et al.

[11] Patent Number: 5,473,296

[45] Date of Patent: Dec. 5, 1995

[54] NONRADIATIVE DIELECTRIC WAVEGUIDE AND MANUFACTURING METHOD THEREOF

[75] Inventors: Youhei Ishikawa, Kyoto; Hiroshi Nishida, Kawanishi; Atsushi Saito, Nagaokakyo, all of Japan

[73] Assignee: Murata Manufacturing Co., Ltd., Japan

[21] Appl. No.: 205,905

[22] Filed: Mar. 3, 1994

[30] Foreign Application Priority Data

Mar. 5, 1993 [JP] Japan ..... 5-070804

[51] Int. Cl.[6] ..... H01P 3/16

[52] U.S. Cl. ..... 333/239; 333/248

[58] Field of Search ..... 333/238, 239, 333/240, 99 R, 248

[56] References Cited

U.S. PATENT DOCUMENTS

| | | | |
|---|---|---|---|
| 2,810,892 | 10/1957 | Blitz | 333/238 |
| 4,028,643 | 6/1977 | Itoh | 333/239 X |
| 4,463,330 | 7/1984 | Yoneyama | 333/239 |

FOREIGN PATENT DOCUMENTS

| | | |
|---|---|---|
| 0054226 | 3/1987 | European Pat. Off. . |
| 2217114 | 10/1989 | United Kingdom . |

OTHER PUBLICATIONS

Great Britain Search Report dated May 26, 1994.

German Office Action dated 20 Sep. 1994 and translation.

*Primary Examiner*—Paul Gensler

*Attorney, Agent, or Firm*—Ostrolenk, Faber, Gerb & Soffen

[57] ABSTRACT

A nonradiative dielectric waveguide which includes a first housing and a second housing. The first housing and the second housing respectively include first and second dielectric units and conductor electrodes. The first and second dielectric units are respectively integrally formed with first and second planar portions, and first and second dielectric strip line portions extending outwardly from said first and second planar portions and by a predetermined height, with abutting faces generally parallel with the conductor electrodes and being provided at top portions of said dielectric strip line portions. The conductor electrodes are respectively formed in close contact with faces of the first and second dielectric units remote from the abutting faces. The first and second housings are overlapped so as to make the abutting faces confront each other. The first and second dielectric strip lines portions cooperate to propagate electromagnetic waves. The disclosure is also directed to a manufacturing method of the above nonradiative dielectric waveguide.

10 Claims, 12 Drawing Sheets

NONRADIATIVE DIELECTRIC WAVEGUIDE AND MANUFACTURING METHOD THEREOF

BACKGROUND OF THE INVENTION

1. Field of the Invention

The present invention generally relates to a dielectric waveguide, and more particularly, to a nonradiative dielectric waveguide used for a millimeter-wave band region, and suitable for millimeter-wave integrated circuits, and also, to a method of manufacturing such a nonradiative dielectric waveguide.

2. Background of the Invention

FIG. 10 shows one example of the construction of a conventional nonradiative dielectric waveguide, which includes a pair of flat plate-like conductor electrodes 101 and 102 disposed generally parallel to each other, and a dielectric strip line 103 held between said conductor electrodes 101 and 102 as shown. The dielectric strip line 103 is formed by a dielectric material such as a resin, ceramics or the like, into approximately a cubic rectangular configuration having a cross section, for example, with a width "b" and a height "c" each of several millimeters in length.

When a distance between the conductor electrodes 101 and 102 is represented by "a", and the wavelength of millimeter wave to be transmitted, in represented by $\lambda$, at a portion without the dielectric strip line 103, propagation of polarized waves parallel to the conductor electrodes 101 and 102 is cut off between said conductor electrodes, if the distance "a" is in a relation $a<\lambda/2$. Meanwhile, at a portion where the dielectric strip line 103 is inserted, the cut off state is eliminated, and the electro-magnetic waves are propagated along the dielectric strip line 103. It is to be noted here that the transmission mode may be broadly divided into LSE mode and LSM mode, and in the $LSE_{01}$ mode and $LSM_{01}$ mode for the lowest order modes, $LSM_{01}$ mode is normally employed from the viewpoint of low loss.

Incidentally, since the width b of the dielectric strip line 103 is small, it is not easy to bond said dielectric strip line 103 to the conductor electrodes 101 and 102. Thus, an effective means for securing the dielectric strip line 103 to the flat conductor electrodes 101 and 102 has not been available. Furthermore, in the case where the dielectric strip line 103 is made of a dielectric material such as Teflon resin or the like, it is particularly difficult to effect bonding. On the other hand, there may be considered a case where circuit components such as a circulator, an isolator, etc. are disposed between the conductor electrodes 101 and 102 to form an integrated circuit together with the conductor electrodes 101 and 102, and the dielectric strip line 103. In such a case, the circuit components can be more easily inserted between the conductor electrodes 101 and 102 when the conductor electrodes 101 and 102 and the dielectric strip line 103 are separated rather than when they are fixed together. Accordingly, in the nonradiative dielectric waveguide referred to above, it is so arranged that the conductor electrodes 101 and 102 and the dielectric strip line 103 are left separated from each other, and the dielectric strip line 103 is placed at a proper position on one conductor electrode 101 and conductor electrode 102 is placed on said dielectric strip line 103, thereby holding the dielectric strip line 103 between said conductor electrodes 101 and 102.

However, in the nonradiative dielectric waveguide described so far with reference to FIG. 10, positioning of the dielectric strip line 103 can not be readily effected, since the dielectric strip line 103 tends to move on the conductor electrode 101. If an integrated circuit is included, positioning of the dielectric strip line 103 itself must be accomplished, as well as the positioning between said dielectric strip line 103 and the circuit components is also required, and such positionings can not be readily effected. Accordingly, there has also been another problem related to low productivity, since the positioning as described above and positioning for properly holding the dielectric strip line 103 between the conductor electrodes 101 and 102 must be repeated many times in order to achieve desired characteristics. Moreover, even when the positioning of the dielectric strip line 103 is properly effected to provide the desired characteristics, deviation in the position of the dielectric strip line 103 tends to readily take place by mechanical vibrations, impacts, etc., since said dielectric strip line 103 is merely held by the conductor electrodes 101 and 102, and thus, there is also a problem that initial characteristics can not be fully maintained, thus lacking in reliability.

Moreover, since the conductor electrodes 101 and 102 are not connected with the dielectric strip line 103, there are cases where so-called side gaps are undesirably formed between the conductor electrode 101 and the strip line 103, and also, between the strip line 103 and conductor electrode 102.

FIG. 11 is a graphical diagram showing $\omega$-$\beta/k0$ curves in the case where the side gaps are formed in the nonradiative dielectric waveguide in FIG. 10. It is to be noted that in FIG. 11, $\omega$ represents an angular frequency (Frequency $f=\omega/2\pi$), $\beta$ denotes a phase constant, and k0 indicates wave number in a vacuum, and that $\beta/k0$ is equal to a ratio of a wavelength in a vacuum to the guide wave length, and the square thereof may be regarded as a relative effective dielectric constant. In the relation $\beta/k0=1$, the guide wave length is equal to the wavelength in a vacuum, and in the relation $\beta/k0>1$, the guide wavelength becomes shorter then the wavelength in a vacuum, while in the relation $\beta/k0<1$, the guide wavelength becomes longer than the wavelength in a vacuum.

The curve designated $\phi 0$ shows that the $\omega$-$\beta/k0$ curve of the $LSM_{01}$ mode at the side gap d=0. Meanwhile, the curves designated $\phi 1$, $\phi 2$, and $\phi 3$ respectively show the $\omega$-$\beta/k0$ curves at the $LSM_{01}$ mode in cases where the side gap d=0.01 mm, side gap d=0.05 mm, and side gap d=0.1 mm take place. In the $LSM_{01}$ mode, since the electric field is weak in the vicinity of the side gap d, and is parallel to the conductor electrodes 101 and 102, energy accumulated at the side gap d is not so large. Therefore, in the $LSM_{01}$ mode, the $\omega$-$\beta/k0$ curve is shifted towards the higher frequency side as the side gap d becomes larger. On the other hand, the $\omega$-$\beta/k0$ curve of $LSE_{01}$ mode at the side gap d=0 is shown in $\psi 0$. Also, the $\omega$ -$\beta/k0$ curves at the $LSE_{01}$ mode when the side gap d=0.01 mm, side gap d=0.05 mm, and the side gap d=0.1 mm are produced, and are respectively represented by $\psi 1$, $\psi 2$ and $\psi 3$. In $LSE_{01}$ mode, since the electric field is strong near the side gap d, and the electric field is perpendicular to the conductor electrodes 101 and 102, the energy accumulated at the side gap d is large. Accordingly, in the $LSE_{01}$ mode, inclination of the $\omega$-$\beta/k0$ curve becomes smaller as the side gap d is increased. Therefore, when the side gap d is produced, the phase constants of the $LSM_{01}$ mode and the $LSE_{01}$ mode become undesirably close to each other (see $\chi$ in FIG. 11). Originally, the $LSM_{01}$ mode and the $LSE_{01}$ mode intersect at right angles to each other, without forming any mode coupling, but coupling is produced due to an asymmetrical nature by working errors. However, almost no coupling is produced if the difference in the phase constants is large, whereas conversely, the coupling tends to be readily produced if the difference in the phase constants is small. In other words, mode coupling tends to be formed since the phase constants of the $LSM_{01}$ mode and the $LSE_{01}$ mode come close to each other, with the consequence of an increase in transmission loss and the deterioration of transmission characteristics.

FIG. 12 shows the construction of another conventional nonradiative dielectric waveguide as disclosed in Japanese Patent Publication Tokkohei No. 1-51202. When a material with a high dielectric constant is employed for the dielectric strip line 103, the guide wave length λg becomes short. Thus, the length of the dielectric strip line 103 may be reduced for compact size of the nonradiative dielectric waveguide or integrated circuit, but on the contrary, the single operating range will become narrow due to generation of a new higher order mode. Moreover, variation of the characteristics due to the side gaps d between the conductor electrodes 101 and 102 and the dielectric strip line 103 tend to appear conspicuously. Therefore, in the nonradiative dielectric waveguide of FIG. 12, a high dielectric constant material is used for the dielectric strip line 103, and dielectric layers 105 are formed into flat plate-like shapes of a dielectric material having a dielectric constant lower than that of the strip line 103. Dielectric layers 105 are interposed between the dielectric strip line 103 and the conductor layers 101 and 102, whereby the single operating region is enlarged, while the variation of characteristics by the side gap is reduced. Furthermore, in the nonradiative dielectric waveguide of FIG. 12, as described so far, since the area for the dielectric layers 105 is large, there is a large bonding area between the conductive electrodes 101 and 102 and the dielectric layers 105, so that they can be readily bonded to each other so as not to be easily separated. Accordingly, the problems related to the positional deviation or side gaps between the conductor electrodes 101 and 102 and the dielectric layers 105 may be advantageously solved.

However, in the known nonradiative dielectric waveguide in FIG. 12, since the dielectric strip line 103 and the dielectric layers 105 are separately formed by different dielectric materials, it is not easy to bond the dielectric strip line 103 to the dielectric layers 105, and therefore, it is difficult to hold the dielectric strip line 103 between the dielectric layers 105. Accordingly, in this nonradiative dielectric waveguide, problems similar to those in the nonradiative dielectric waveguide of FIG. 10 also occur, i.e., problems of productivity, reliability and transmission characteristics.

FIG. 13 shows the construction of still another conventional nonradiative dielectric waveguide. In order to solve the problems related to the productivity and reliability in the known nonradiative dielectric waveguides described so far with reference to FIGS. 10 and 12, the nonradiative dielectric waveguide in FIG. 13 is formed with grooves 104 with a depth d for receiving the dielectric strip line 103 at predetermined corresponding positions of the conductor electrodes 101 and 102. Therefore, since the dielectric strip line 103 is properly positioned by merely fitting said strip line 103 into said grooves 104 without any particular consideration for the positioning thereof, assembling of the waveguide may be simplified for improvement of productivity. Moreover, although the strip line 103 is only held between the conductor electrodes 101 and 102, there is no possibility of positional deviation by mechanical vibrations and impacts, etc., since the strip line 103 is fitted in the grooves 104, and thus, initial characteristics of the waveguide may be maintained for higher reliability.

However, in the nonradiative dielectric waveguide in FIG. 13, there is another problem, and that is that high frequency current tends to concentrate upon corner portions ξ of the grooves 104 by the characteristics of the high frequency wave, thus resulting in an increase of transmission loss. Moreover, the problem related to the deterioration of the transmission characteristics attributable to the mode coupling has not been solved in the waveguide of FIG. 13. FIG. 14 is a graphical diagram showing ω-β/k0 curves for the nonradiative dielectric waveguide of FIG. 13. In FIG. 14, Φ0 represents the ω-β/k0 curve for the $LSM_{01}$ mode at the groove depth d=0, while ϕ1 shows the ω-β/k0 curve for the $LSM_{01}$ mode at the groove depth d=0.2 mm. Thus, it is observed that, in the $LSM_{01}$ mode, even when the groove depth d is increased, the ω-β/k0 curve is only slightly shifted towards the lower side of the frequency. Meanwhile, ψ0 shows the ω-β/k0 curve in the $LSE_{01}$ mode at the groove depth d=0, while ψ1 represents the ω-β/k0 curve in the $LSE_{01}$ mode at the groove depth=0.2 mm. In this case, it is seen that the ω-β/k0 curve is shifted to the higher side of frequency as the depth d of the groove increases. Accordingly, the ω-β/k0 curves for the $LSM_{01}$ mode and the $LSE_{01}$ mode approach each other to be finally overlapped (see χ in FIG. 14). In other words, since the phase constants for the $LSM_{01}$ mode and the $LSE_{01}$ mode are close to each other, there is still the problem of mode coupling resulting in an increase in transmission a deterioration of transmission characteristics.

FIG. 15 shows a construction of the further known nonradiative dielectric waveguide, which is disclosed in Japanese Patent Laid-Open Publication Tokkaihei No. 3-270401. The nonradiative dielectric in FIG. 15 includes a dielectric unit 107 and conductor electrodes 101 and 102 in order to solve the reliability problem resulting from positional deviation, and the problem of deterioration of transmission characteristics resulting from mode coupling. The dielectric unit 107 includes a dielectric strip line 103 disposed at a predetermined position, and having a vertical height H in a longitudinal direction and set to be smaller than half a wavelength, and planar portions 106 integrally formed with the strip line 103 and extending laterally in the left and right direction from the upper and lower edges of said strip line 103 so as to form an H-shaped cross section. The conductive electrodes 101 and 102 are formed in close contact on the outer surfaces of the planar portions 106, as shown.

In the nonradiative dielectric waveguide of FIG. 15, since the contact area between the dielectric strip line 103, planar portions 106 and conductor electrodes 101 and 102 are sufficiently large for close contact, there is no possibility that the dielectric strip line 103 and the planar portions 106 are separated from the conductor electrodes 101 and 102. Furthermore, since the dielectric strip line 103 is disposed at the predetermined position, it is not necessary to pay particular attention to the positioning of the strip line 103, or to the positional deviation thereof due to mechanical vibrations and impacts, and thus, it becomes possible to improve the productivity and reliability.

Moreover, there is no possibility that a side gap is produced between the conductor electrodes 101 and 102 and the dielectric strip line 103.

FIG. 16 is a graphical diagram showing ω-β/k0 curves for the nonradiative dielectric waveguide of FIG. 15. In FIG. 16, ϕ0 represents the ω-β/k0 curve for the $LSM_{01}$ mode when the planar portion 106 is of thickness e=0. Meanwhile, ϕ1, ϕ2 and ϕ3 respectively show the ω-β/k0 curves for the $LSM_{01}$ mode when the planar portion 106 is of thicknesses e=0.1 mm, e=0.2 mm, and e= 0.3 mm, whereby it is seen that in the $LSM_{01}$ mode, the ω-β/k0 curves are shifted towards the lower frequency as the thickness of the flange portion 106 increases. On the other hand, ψ0 represents the ω-β/k0 curve in the $LSE_{01}$ mode when the planar portion 106 in of thickness e=0, while ψ1, ψ2 and ψ3 respectively show the ω-β/k0 curves in the $LSE_{01}$ mode when the planar portion 106 is of thicknesses e=0.1 mm, e=0.2 mm and e= 0.3 mm, whereby it is seen that in the $LSE_{01}$ mode, the ω-β/k0 curves are only slightly shifted towards the lower frequency even when the thickness e of the planar portion 106 is increased. However, since the ω-β/k0 curves for $LSM_{01}$ mode and $LSE_{01}$ mode are sufficiently spaced apart, no mode coupling or transmission loss is produced to provide a stable performance as the transmission waveguide, and thus, the problem related to the transmission characteristics resulting from the side gaps may be advantageously solved.

However, in the conventional nonradiative dielectric waveguide as shown in FIG. 15, in the case where a circuit component is to be inserted between the conductor electrodes 101 and 102, the mounting of such a component therebetween is not easily done, since the dielectric strip line 103 and the planar portion 106 are fixedly bonded to each other, and thus, there is the problem that this arrangement is not suitable for formation with an integrated circuit.

In short, in the conventional nonradiative dielectric waveguides, there is either a problem relating to productivity, reliability or transmission characteristics.

SUMMARY OF THE INVENTION

Accordingly, an essential object of the present invention is to provide a nonradiative dielectric waveguide which is high in reliability and superior in transmission characteristics, and which can be readily formed with an integrated circuit for improved productivity, and thereby eliminating the disadvantages inherent in conventional arrangements of nonradiative dielectric waveguides.

Another object of the present invention is to provide a method of manufacturing a nonradiative dielectric waveguide of the above described type in an efficient manner and at low cost.

In accomplishing these and other objects, according to one embodiment of the present invention, there is provided a nonradiative dielectric waveguide including a set of flat plate-like conductor electrodes disposed generally parallel to each other and dielectric strip line made of a dielectric material and disposed between the conductor electrodes, with a distance between the conductor electrodes being smaller than half a wavelength of the electromagnetic waves propagated along the dielectric strip line. The nonradiative dielectric waveguide comprises a first housing and a second housing. The first housing further includes a first dielectric unit having a first planar portion and a first dielectric strip line portion integrally formed therewith and being part of the dielectric strip line and extending upwardly from the first planar portion at a predetermined position and by a predetermined height, with an abutting face generally parallel with the conductor electrodes being provided at its top portion. One electrode of the conductor electrodes is formed in close contact with a face of the first dielectric unit, at a side opposite to said abutting face. The second housing further includes a second dielectric unit having a second planar portion, and a second dielectric strip line portion integrally formed therewith and being the remaining portion of the dielectric strip line so as to extend upwardly from said second planar portion at a predetermined position and by a predetermined height, with an abutting face generally parallel with the conductor electrodes being provided at its top portion. The other electrode of the conductor electrodes is formed in close contact with a face of the second dielectric unit, at a side opposite to the abutting face. The abutting face of the first dielectric strip line portion confronts the abutting face of the second strip line portion between the conductor electrodes by overlapping the first and second housings so that the first and second dielectric strip line portions cooperate to propagate electromagnetic waves.

In the nonradiative dielectric waveguide according to the present invention as described above, by providing the first and second dielectric strip line portions at the predetermined positions of the first and second dielectric units, the work of positioning may be dispensed with, while by forming the conductor electrodes in close contact with the first and second dielectric units, the work of inserting the first and second dielectric strip line portions becomes unnecessary for improved productivity. Moreover, since the contact area between the first and second strip line portions, first and second planar portions and both of the conductor electrodes may be enlarged, there is no possibility that the first and second dielectric strip line portions are positionally deviated by mechanical vibrations and impacts, etc., and thus, initial characteristics can be maintained for improvement of reliability, while formation of side gaps between the first and second dielectric strip line portions and conductor electrodes are advantageously eliminated, thereby preventing deterioration of transmission characteristics resulting from such side gaps. Furthermore, since the housing is divided into first and second housings, disposition of circuit components between the conductor electrodes may be facilitated for formation into an integrated circuit.

In another embodiment, the present invention provides a method of manufacturing a nonradiative dielectric waveguide including a first dielectric member having a first face and a second face opposed to each other, a second dielectric member having a third face and a fourth face opposed to each other, and prepared as a member separate from the first dielectric member, with the third face being disposed to confront the second face of the first dielectric member through a predetermined distance. A dielectric strip line portion is located between the first dielectric member and the second-dielectric member, and formed by projecting part of both of the first and second dielectric members or part of either one of the first and second dielectric members. A first conductor electrode is formed to closely contact the first face of the first dielectric member, and a second conductor electrode is formed to closely contact the fourth face of the second dielectric member. The first dielectric member and the second dielectric member have a pair of abutting faces extending along the dielectric strip line portion. The first and second dielectric members are formed into one unit through the dielectric strip line portion by close contact at the abutting faces. The manufacturing method comprises the steps of providing a circuit component between the second face of the first dielectric member, and the third face of the second dielectric member in a process where the pair of abutting faces are not in a state of close contact, and thereafter closely contacting the pair of abutting faces each other.

In the method of manufacturing the nonradiative dielectric waveguide of the present invention as described above, since it is so arranged that in the process in which the pair of abutting faces are not in a state of close contact with each other, the abutting faces are adapted to closely contact each other after the circuit component is provided between the second face of the first dielectric member and the third face of the second dielectric member, thereby disposition of the circuit component is facilitated, and the nonradiative dielectric waveguide is formed with the integrated circuit.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1A:
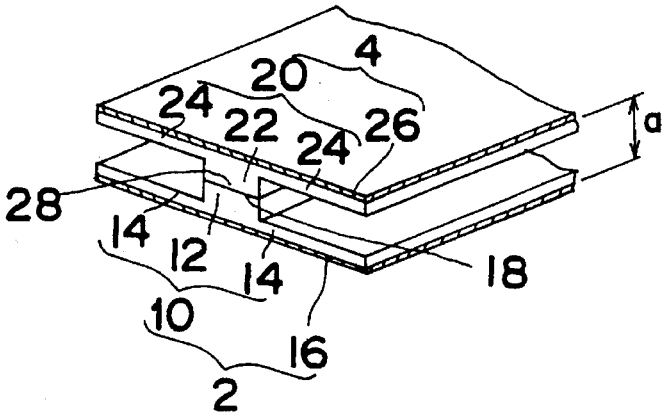
FIGS. 1A to 1C are fragmentary perspective views showing constructions of a nonradiative dielectric waveguide according to one preferred embodiment of the present invention.

Before the description of the present invention proceeds, it is to be noted that like parts are designated by like reference numerals throughout the accompanying drawings.

Figure 1B:
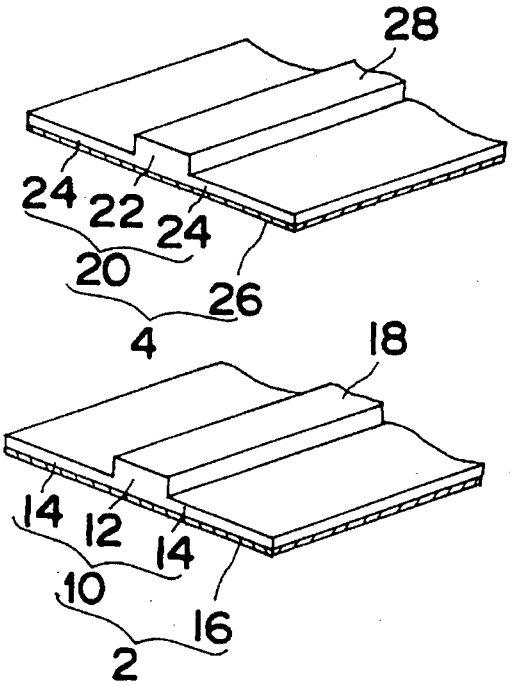
Figure 1C:
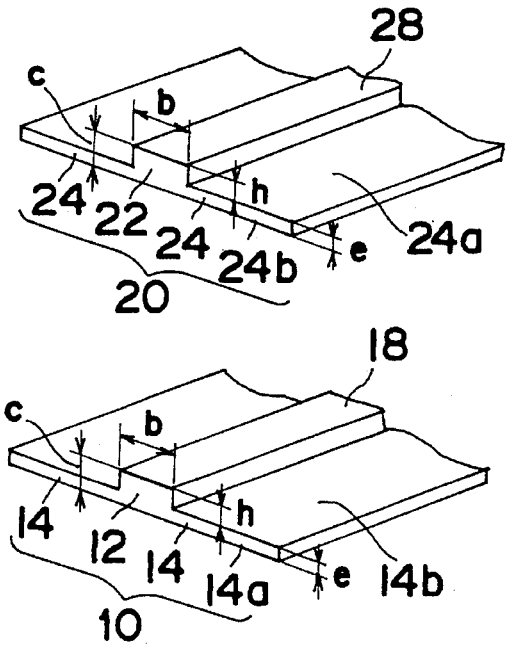

Referring now to the drawings, there is shown in FIGS. 1A to 1C, a nonradiative dielectric waveguide according to one preferred embodiment of the present invention, which generally includes a first housing 2 and a second housing 4 (FIG. 1A). The first housing 2 further includes a first dielectric unit 10 and a conductor electrode 16 (FIG. 1B). The first dielectric unit 10 has a first planar portion 14 and a first dielectric strip line portion 12 which is integrally formed with said planar portion 14 (FIG. 1C). This first dielectric unit 10 is prepared by subjecting a dielectric material of resin capable of plating (e.g., Vectora (name used in trade), Teflon (registered trade mark)), etc., to injection molding by using a metal mold of a predetermined shape. The above first planar portion 14 functions as a first planar dielectric member, and is formed to have a generally constant thickness e (e.g., 0.2 mm). The first dielectric strip line portion 12 has a predetermined width b (e.g., 1.7 mm) at a predetermined position, and extends outwardly by a specific height h (e.g., 0.8 mm) from a second face 14*b* of the first planar portion 14, with a flat abutting face 18 being provided at its top portion. Therefore, a thickness c of the first dielectric strip line portion 12 will become h+e (e.g., 1 mm). On the face opposite abutting face 18 of the first dielectric unit 10, i.e., on a first face 14*a* thereof, the conductor electrode 16 is formed by plating copper, silver, etc., whereby the conductor electrode 16 is provided by closely contacting the first dielectric unit (FIG. 1B).

Similarly to the first housing 2, the second housing 4 includes a second dielectric unit 20 and a conductor electrode 26 (FIG. 1B). The second dielectric unit 20 has a second planar portion 24 and a second dielectric strip line portion 22 which is integrally formed with said planar portion 24 (FIG. 1C) in a similar manner to the first dielectric unit 10. This second dielectric unit 20 is prepared by subjecting material similar to that of the first dielectric unit 10 to injection molding by using a metal mold in a plane symmetry with that of the first dielectric unit 10. The above second planar portion 24 functions as a second planar dielectric member, and is formed as a separate member from the first planar portion 14, into a plate-like shape having a generally constant thickness e (e.g., 0.2 mm). The second dielectric strip line portion 22 has a predetermined width b (e.g., 1.7 mm) at a predetermined position, and extends outwardly by a specific height h (e.g., 0.8 mm) from a third face 24*b* of the second planar portion 24, with a flat abutting face 28 being provided at its top portion. Therefore, the thickness c of the second dielectric strip line portion 22 will also become h+e (e.g., 1 mm). On the face contrary to the abutting face 28 of the second dielectric unit 20, i.e., on a fourth face 24*b* thereof, the conductor electrode 26 is formed by plating copper, silver, etc., whereby the conductor electrode 26 is provided by closely contacting the second dielectric unit 20 (FIG. 1B). Thus, one dielectric strip line is constituted by the first dielectric strip line portion 12 and the second dielectric strip line portion 22.

The first housing 2 and the second housing 4 are laid to overlap each other, whereby between the conductor electrodes 16 and 26, the abutting face 18 of the first strip line portion 12 confronts the abutting face 28 of the second dielectric strip line portion 22 for contact of the abutting faces 18 and 28 to each other. Since the thickness of each of the first and second dielectric strip line portions 12 and 22 is c, the respective abutting faces 18 and 28 are located at the central portion between the conductor electrodes 16 and 26. It is to be noted here that a distance "a" between the conductive electrodes 16 and 26 is selected at a relation a $\leqq\lambda/2$ when the wavelength of the electro-magnetic wave is represented by $\lambda$. By the above arrangement, propagation of the electro-magnetic waves is cut off at the portion where the dielectric strip line portions 12 and 22 are not present. Meanwhile, at the portion where the dielectric strip line 12 and 22 are present, the cut off state is eliminated, and the first dielectric strip line portion 12 and the second dielectric strip line portion 22 cooperate to propagate the electro-magnetic waves. It is to be noted here, that although $LSE_{01}$ mode and $LSM_{01}$ mode, etc. may be available as the mode of the electro-magnetic waves, $LSM_{01}$ mode is normally employed from the viewpoint of its low loss characteristics. It should also be noted that, although $LSE_{01}$ mode and $LSM_{01}$ mode intersect at right angles to each other so as not to be coupled, coupling takes place in some cases due the to asymmetrical nature of processing errors. In this case, if the difference in the phase constants of the two modes is large, almost no energy is transferred, without presenting any problem, but in the case where the phase constant difference is small, the coupling tends to be formed.

Figure 2:
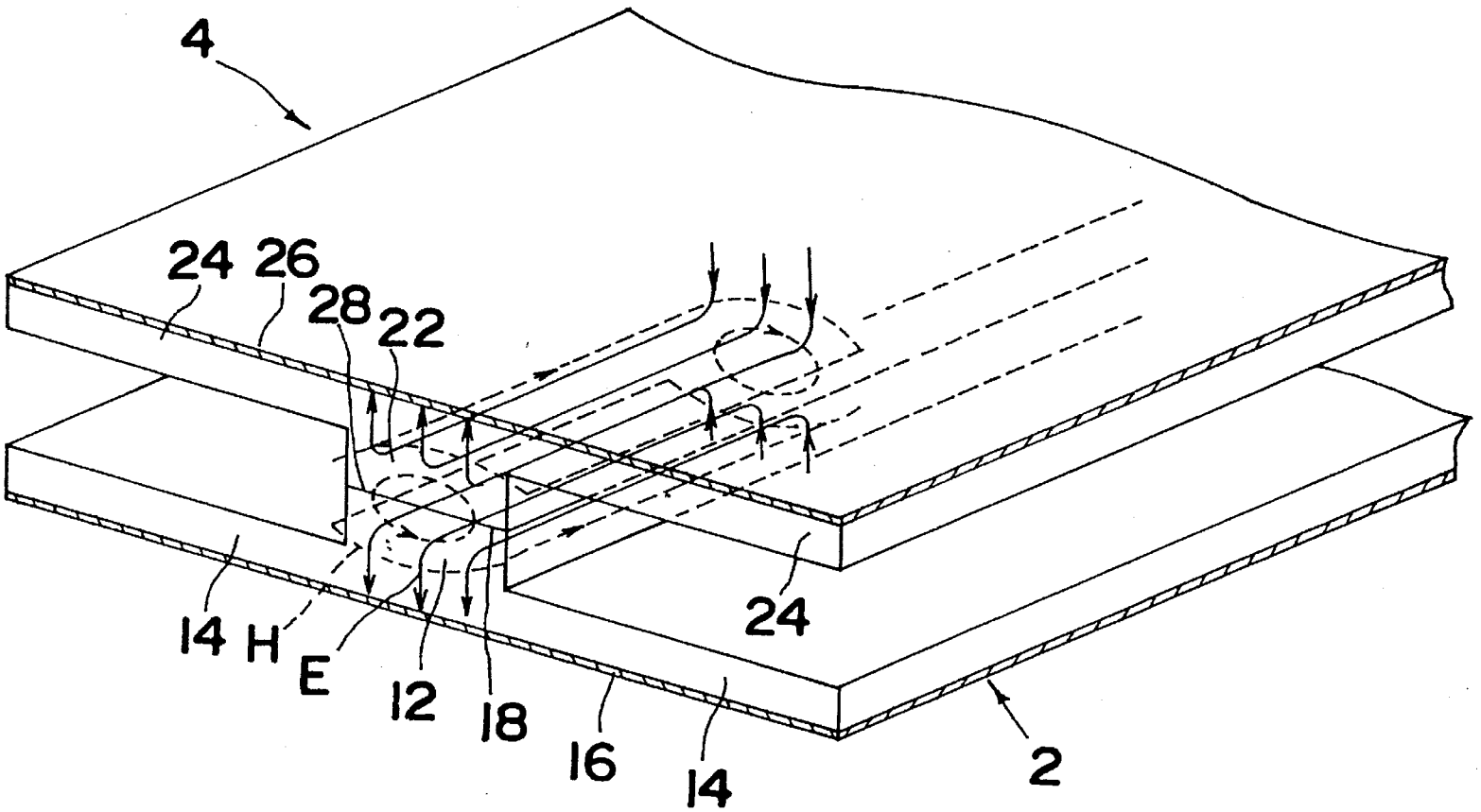
FIG. 2 is a fragmentary perspective view on an enlarged scale, of the nonradiative dielectric waveguide of FIG. 1A showing electro-magnetic lines of force of the $LSE_{01}$ mode.

FIG. 2 is a fragmentary perspective view showing electro-magnetic lines of force of the $LSE_{01}$ mode for the nonradiative dielectric waveguide in FIGS. 1A to 1C. The $LSE_{01}$ mode relates to the electro-magnetic wave in which the electric field E is parallel with a boundary face of the dielectric strip line portions 12 and 22 and air. At the first dielectric strip line portion 12, the electric field E has a component perpendicular to the conductor electrode 16 and a component parallel to the conductor electrode 16 passing in the vicinity of the abutting face 18 and advancing in the longitudinal direction of the first dielectric strip line portion 12. At the second dielectric strip line portion 22, the electric field E has a component perpendicular to the conductor electrode 26 and a component parallel to the conductor electrode 26 passing in the vicinity of the abutting face 28 and advancing in the longitudinal direction of the second dielectric strip line portion 22. The magnetic field H is produced around the electric field E of the first and second dielectric strip line portions 12 and 22, whereby the first dielectric strip line portion 12 and the second dielectric strip line portion 22 cooperate to propagate the electromagnetic waves of the $LSE_{01}$ mode.

Figure 3:
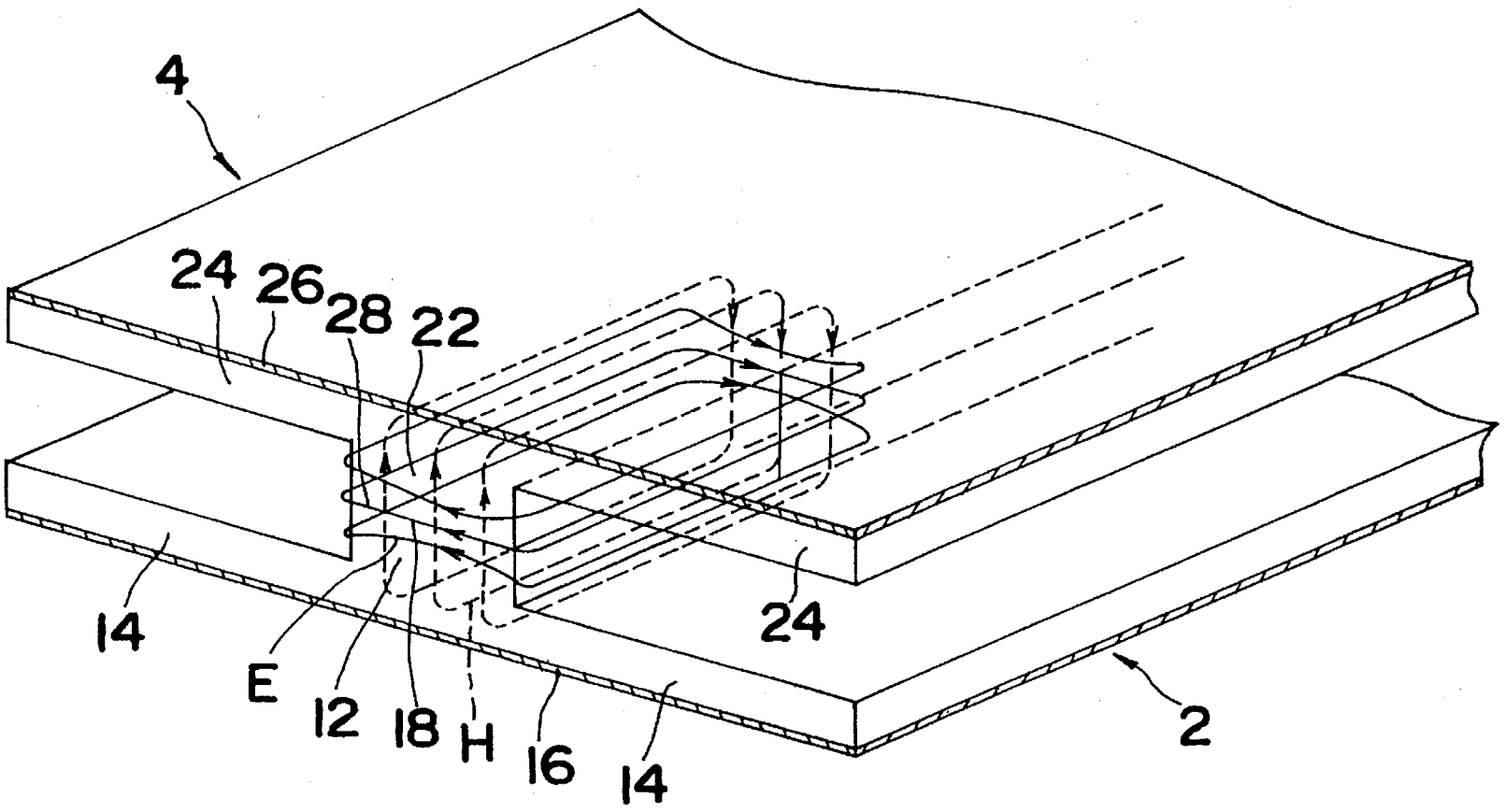
FIG. 3 is a fragmentary perspective view on an enlarged scale, of the nonradiative dielectric waveguide of FIGS. 1A to 1C showing electro-magnetic lines of force of the $LSM_{01}$ mode.

FIG. 3 is a fragmentary perspective view showing electro-magnetic lines of force of the $LSM_{01}$ mode for the nonradiative dielectric waveguide in FIGS. 1A to 1C. The $LSM_{01}$ mode relates to the electro-magnetic wave in which the magnetic field H is parallel with a boundary face of the dielectric strip line portions 12 and 22 and air. At the first and second dielectric strip line portions 12 and 22, the magnetic field H has a component perpendicular to the conductor electrodes 16 and 26 and a component parallel to the conductor electrodes 16 and 26, and advancing in the longitudinal direction of the first and second dielectric strip line portions 12 and 22. The electric field E is produced around the magnetic field H of the first and second dielectric strip line portions 12 and 22, whereby the first dielectric strip line portion 12 and the second dielectric strip line portion 22 cooperate to propagate the electro-magnetic waves of the $LSM_{01}$ mode.

In the above embodiment, since the first and second dielectric strip line portions 12 and 22 are disposed at predetermined positions on the first and second dielectric units 10 and 20, positioning work may be completely dispensed with. Moreover, since the conductor electrodes 16 and 26 are formed to closely contact the first and second dielectric units 10 and 20, the inserting work of the first and second dielectric strip line portions 12 and 22 also becomes completely unnecessary, with a consequent improvement of the productivity. Moreover, owing to the arrangement that a large contact area can be taken between the first and second dielectric strip line portions 12 and 22, and the first and second planar portions 14 and 24, and both of the conductor electrodes 16 and 26, there is no possibility that the first and second dielectric strip line portions 12 and 22 are positionally deviated by mechanical vibrations, impacts, etc., and thus, initial characteristics may be advantageously maintained for improved reliability. Furthermore, side gaps are not formed between the first and second dielectric strip line portions 12 and 22 and the conductor electrodes 16 and 26, and thus, deterioration of the transmission characteristics arising from the side gaps can also be prevented. Additionally, owing to the division into the first and second housings 2 and 4, installation of circuit components between the conductor electrodes 16 and 26 may be facilitated for formation into an integrated circuit.

In the above arrangement, it is desired that the distance a between the conductor electrodes 16 and 26 is equal to a sum $2c$ of a thickness c of each of the dielectric strip line portions 12 and 22, and that a center gap (FIG. 4) is not formed between the abutting face 18 of the dielectric strip line portion 12 and the abutting face 28 of the dielectric strip line portion 22. However, in the case where the circuit component is larger than a standard item, there is a case where the center gap d undesirably takes place. Hereinafter, the transmission characteristics of such nonradiative dielectric waveguide will be described.

Figure 4:
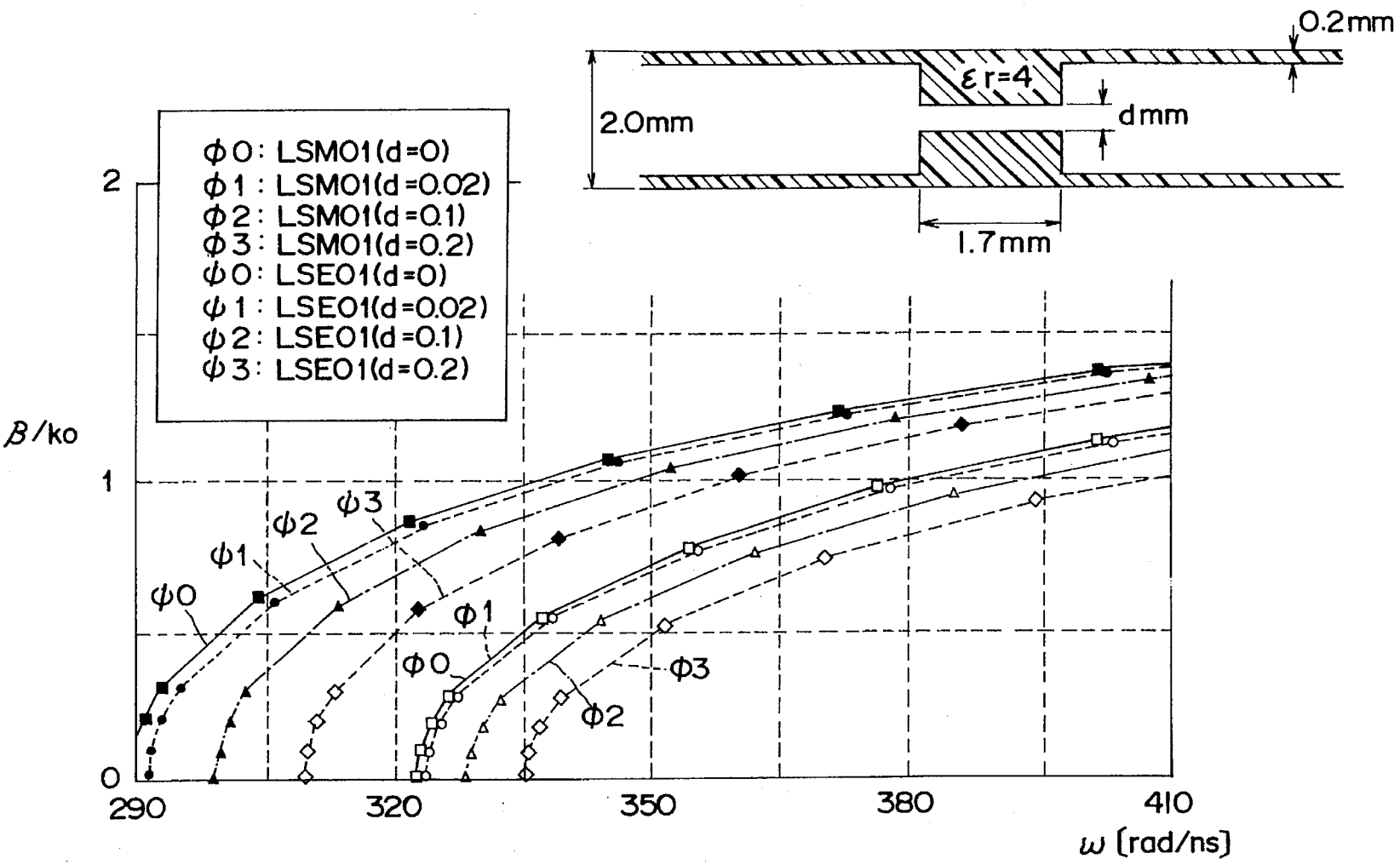
FIG. 4 is a graphical diagram showing $\omega$-$\beta$/k0 curves of the nonradiative dielectric waveguide related to the embodiment of FIGS. 1A to 1C.

FIG. 4 is a graphical diagram showing $\omega$-$\beta/k0$ curves of the nonradiative dielectric waveguide in the embodiment of FIGS. 1A to 1C. It is assumed that a small center gap d (d=0, 0.1 mm, 0.2 mm, 0.3 mm) is formed between the dielectric strip line portion 12 and the dielectric strip line portion 22. In this case, in $LSM_{01}$ mode, the electric lines of force of the electric field E are produced in parallel with the abutting faces 18 and 28 (FIG. 2). Accordingly, concentration degree of energy between the center gaps is not high, and thus, the effective dielectric constant is maintained as it is, with the phase constant $\beta$ being also maintained as it is. Meanwhile, the cut-off frequency becomes higher, whereby in $LSM_{01}$ mode, the $\omega$-$\beta/k0$ characteristics are shifted rightwards without being inclined downwards as the center gap interval is increased. On the other hand, in $LSE_{01}$ mode also, the electric lines of force of the electric field E are produced in parallel to the abutting faces 18 and 28 (FIG. 3). Therefore, the influence of the gap appear in the similar manner both in $LSM_{01}$ mode and $LSE_{01}$ mode, and $\omega$-$\beta/k0$ characteristics are shifted rightwards without being inclined downwards. Accordingly, there is no possibility that $LSM_{01}$ mode and $LSE_{01}$ mode overlap each other, and thus, favorable transmission characteristics may be maintained irrespective of generation of the center gap d.

Figure 5:
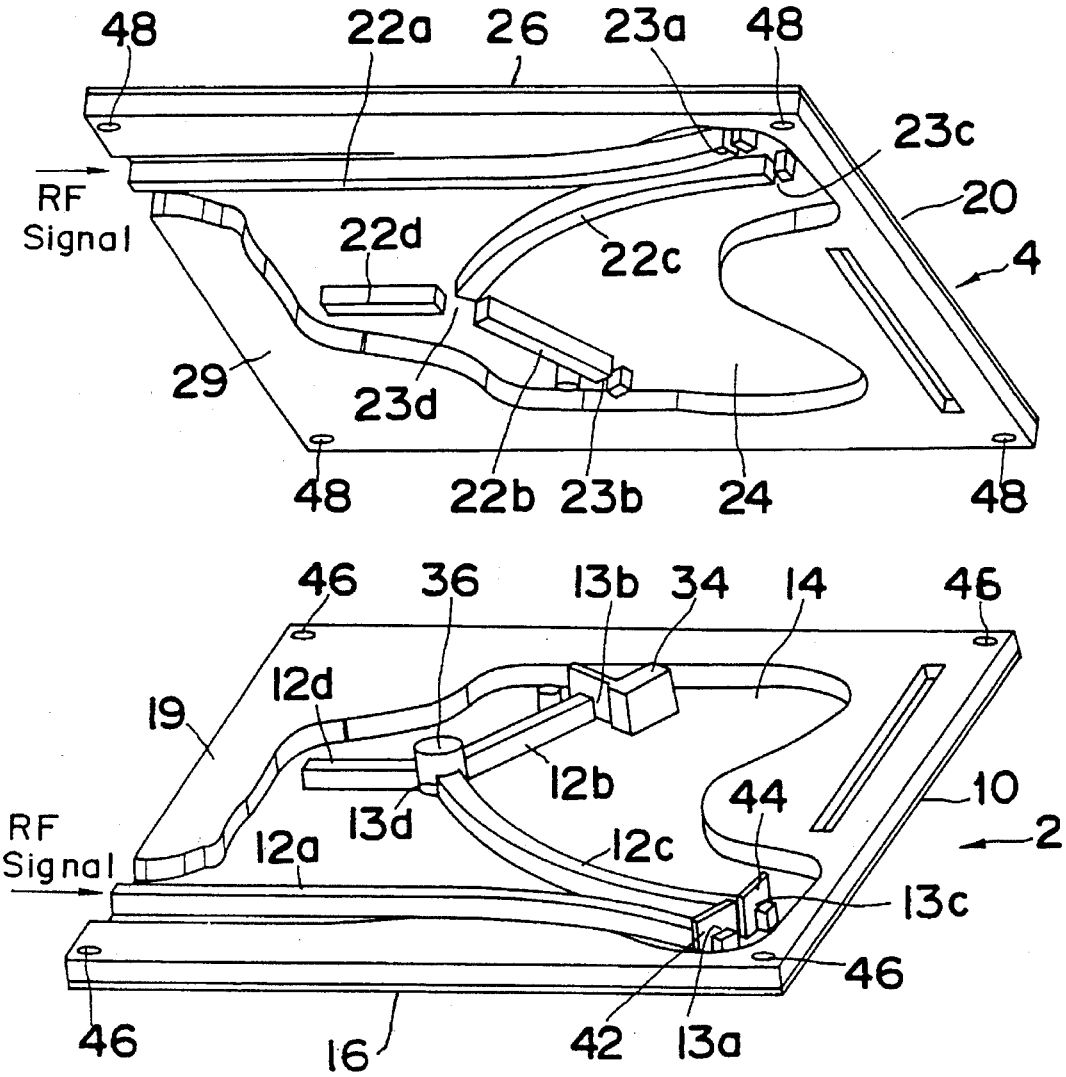
FIG. 5 is a perspective view showing the construction of a nonradiative dielectric waveguide in the case where the front end of a receiver is formed into an integrated circuit.
Figure 6:
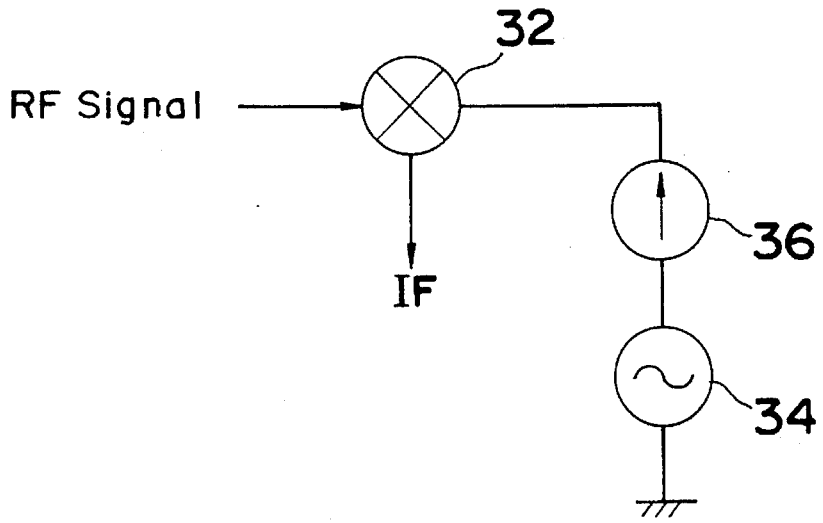
FIG. 6 is a circuit diagram showing an equivalent circuit of the front end of the receiver for the nonradiative dielectric waveguide of FIG. 5.

FIG. 5 is a perspective view showing the construction of a nonradiative dielectric waveguide in the case where the front end of a receiver is formed into an integrated circuit, and FIG. 6 is a circuit diagram showing an equivalent circuit of the front end for the receiver of the nonradiative dielectric waveguide in FIG. 5.

In FIG. 6, RF signal of millimeter wave band received by an antenna (not shown) is given to a mixer 32. Meanwhile, the signal outputted from a local oscillator 34 is applied to the mixer 32 through a circulator 36 functioning as an isolator. The mixer 32 subjects the RF signal to a frequency conversion into an intermediate frequency of microwave band.

In FIG. 5, the first dielectric unit 10 of the first housing 2 includes the first planar portion 14, a first dielectric strip line portion 12*a* for propagating RF signals of the millimeter band, a first dielectric strip line portion 12*b* for propagating the signal from an oscillator 34 to a circulator 36, a first dielectric strip line portion 12*c* for propagating signals from the circulator 36, a first dielectric strip line portion 12*d* for causing the circulator 36 to function as an isolator, and a frame 19. In the first dielectric strip line portions 12*a*, 12*b* and 12*c*, gaps 13*a*, 13*b* and 13*c* are respectively provided for mounting a Teflon substrate 42, the oscillator 34 and a Teflon substrate 44. Between the first dielectric strip line portions 12*b*, 12*c* and 12*d*, a gap 13*d* is provided for attaching the circulator 36. The conductor electrode 16 is formed to closely adhere to the reverse face of the first dielectric unit 10.

The second dielectric unit 20 of the second housing 4 is formed into a plane symmetry with respect to the first dielectric unit 10 and includes the second planar portion 24, a second dielectric strip line portion 22*a* for propagating RF signals of the millimeter band, a second dielectric strip line portion 22*b* for propagating the signal from the oscillator 34 to the circulator 36, a second dielectric strip line portion 22*c* for propagating signals from the circulator 36, a second dielectric strip line portion 22*d* for causing the circulator 36 to function as an isolator, and a frame 29. In the second dielectric strip line portions 22*a*, 22*b* and 22*c*, gaps, 23*a*, 23*b* and 23*c* are respectively provided for mounting the Teflon substrate 42, oscillator 34 and Teflon substrate 44. Between the second dielectric strip line portions 22*b*, 22*c* and 22*d*, a gap 23*d* is provided for attaching the circulator 36. The conductor electrode 26 is formed to closely adhere to the reverse face of the second dielectric unit 20.

In order to couple the electro-magnetic field propagating through the respective first dielectric strip line portions 12*a*, 12*b*, 12*c* and 12*d*, with the electro-magnetic field of the oscillator 34, circulator 36 and Teflon substrates 42 and 44, the lower portions of the Teflon substrate 42, oscillator 34, Teflon substrate 44 and circulator 36 are each attached to the respective gaps 13*a*, 13*b*, 13*c* and 13*d*. At the side of the conductor electrode 16 corresponding to the Teflon substrates 42 and 44, a mixer 32 is provided for frequency conversion from the millimeter wave to the microwaves. (not shown).

In the above state, when the second housing 4 is applied over the first housing 2, the upper portion of the oscillator 34 is mounted in the gap 23*b*, and the upper portion of the circulator 36 is mounted in the gap 23*d*. The upper portions of the Teflon substrates 42 and 44 are respectively mounted in the gaps 23*a* and 23*c*. Meanwhile, the respective abutting faces 18 of the first dielectric strip line portions 12*a*, 12*b*, 12*c* and 12*d* confront the corresponding abutting faces 28 of the second dielectric strip line portions 22*a*, 22*b*, 22*c*, and 22*d* for contact with each other. When combining members are fitted into respective holes 46 and 48 provided in the first housing 2 and second housing 4, the respective abutting faces 18 and 28 contact more rigidly, thereby preventing the oscillator 34, circulator 36, Teflon substrates 42 and 44 from being positionally deviated. Accordingly, the productivity and reliability may be improved for maintaining the transmission characteristics, and moreover, formation of the waveguide into an integrated circuit can be facilitated.

Figure 7:
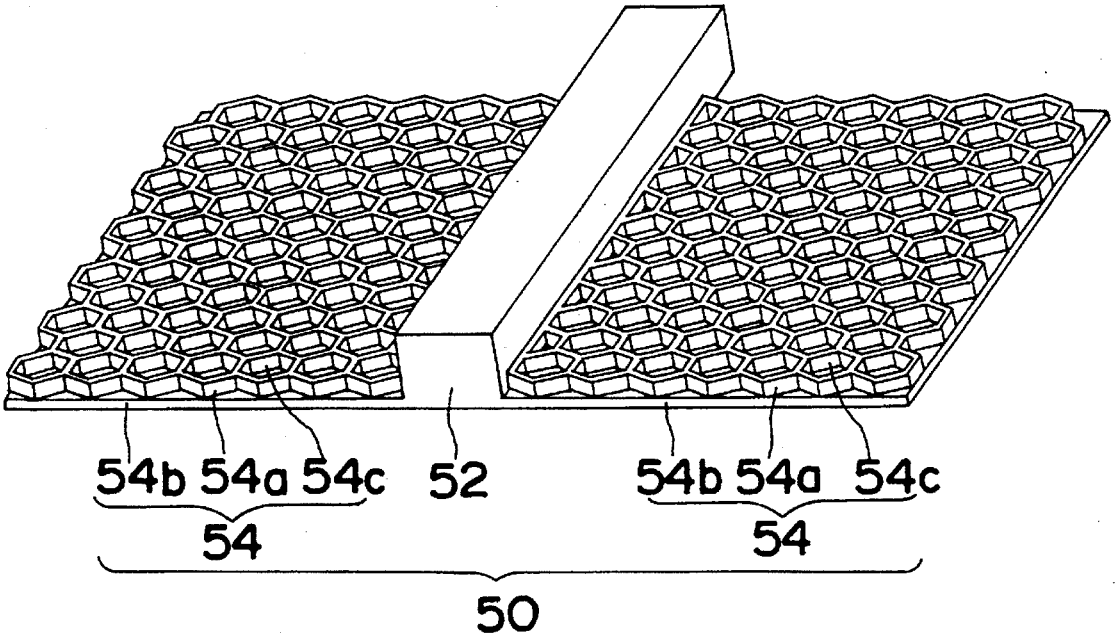
FIG. 7 is a perspective view showing the construction of a dielectric unit to be used for a nonradiative dielectric waveguide according to another embodiment of the present invention.
Figure 16:
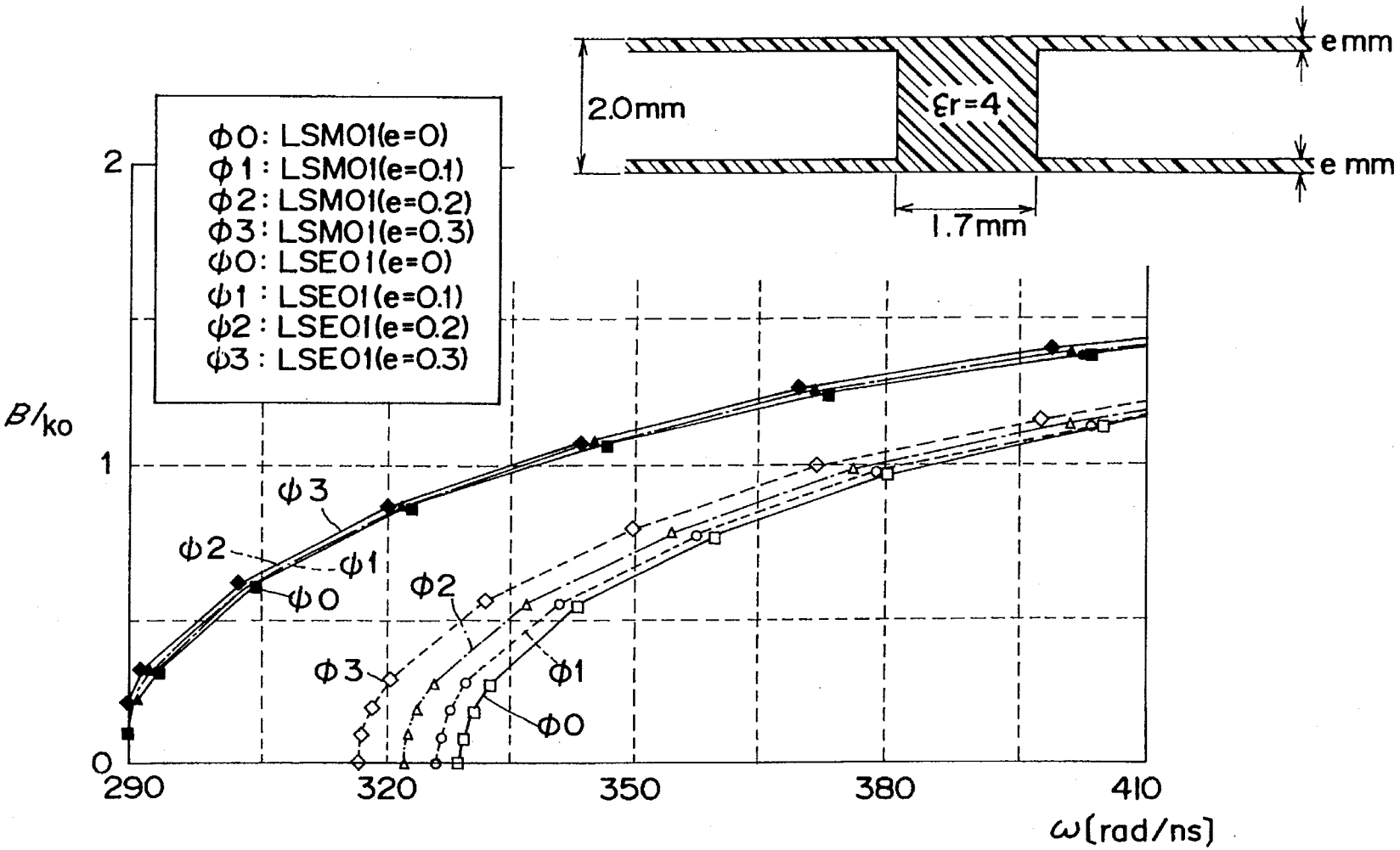
Fig. 16 PRIOR ART
FIG. 16 is a graphical diagram showing $\omega$-$\beta$/k0 curves of the nonradiative dielectric waveguide of FIG. 15.

FIG. 7 is a perspective view of a dielectric unit to be used for a nonradiative dielectric waveguide of another embodiment. In this embodiment, the dielectric unit 50 has a honeycomb structure 54a in its planar portion 54. Here, referring to FIG. 16, it is seen that the $\omega$-$\beta$/k0 curves for LSM mode are more spaced from $\omega$-$\beta$/k0 curves for LSE mode so as not to readily form the mode coupling, as the thickness d of the planar portion 54 is reduced. In other words, as the dielectric constant at the planar portion becomes lower, the $\omega$-$\beta$/k0 curve for LSM mode is more spaced from the $\omega$-$\beta$/k0 curve of LSE mode for difficulty in producing the mode coupling. On the other hand, when the dielectric unit 50 is constituted by forming the dielectric strip line portion 52 and the planar portion 54 into one unit by the injection molding of a dielectric material of a resin, it is difficult to reduce the dielectric constant of the flat portion 54 lower than that of the dielectric strip line portion 52, since the dielectric material for the dielectric strip line portion 52 and that for the flat portion 54 can not be easily changed. Therefore, it is considered to lower the effective dielectric constant of the planar portion 54 by reducing the thickness of the planar portion 54. However, in the injection molding, there is a limit to the thinning (e.g., 0.1 mm), and such planar portion 54 can not be removed, either due to necessity for closely contacting the conductor electrode therewith. Moreover, if the flat portion 54 is made too thin, there are cases where circuit components can not be mounted, since the mechanical strength of the planar portion 54 is not maintained, or center gaps are undesirably formed.

In the above embodiment of FIG. 7, it is so arranged to integrally form the honeycomb structure 54*a* of 0.2 mm in thickness, with the planar portion main body 54*b* of 0.1 mm in thickness. Such molding may be readily effected by the injection molding. Accordingly, if the honeycomb structure 54*a* is applied to the planar portion 54, the thickness of the planar portion 54 may be reduced, with the mechanical strength thereof maintained. Furthermore, by the dents or recesses 54*c* to be formed by the honeycomb structure 54*a*, the effective dielectric constant of the planar portion 54 may be reduced.

It is to be noted here that in the above embodiment, although the dielectric unit is arranged to be formed by using the dielectric material of resin, such dielectric material may be replaced by that of ceramics. Moreover, in the case where ceramics are employed, since the dielectric constants for the dielectric strip line portion and the planar portion may be readily changed through addition of a mixture, the dielectric constant of the planar portion may be lowered by the addition of the mixture. Furthermore, in the above embodiment, although the conductor electrode is formed in close contact with the dielectric unit by plating, such conductor electrode may be formed through close contact on the dielectric unit by deposition, flame spray coating, and baking, etc. Additionally in the foregoing embodiment, the height of the first dielectric strip line portion 12 extending outwardly from the first planar portion 14 is adapted to be equal to the height of the second dielectric strip line portion 22 extending outwardly from the second planar portion 24, but such heights may be arranged to be different from each other, although equal heights are preferable if the case where the center gap takes place is taken into account.

Meanwhile, in the foregoing embodiment, although it is so arranged that part of each of the first planar portion 14 and the second planar portion 24 is protruded to form the first dielectric strip line portion 12 and the second dielectric strip line portion 22, with the abutting faces 18 and 28 thereof being adapted to be located between the second face 14*b* and the third face 24*a*, this may, for example, be so modified that part of either one of the first planar portion 14 or second planar portion 24 is protruded to form the dielectric strip line, with the abutting faces being adapted to be located between the first face 14*a* and second face 14*b*, or between the second face 14*b* and the third face 24*a*, or between third face 24*a* and the fourth face 24*b*. When the abutting faces are to be located between the first face 14*a* and the second face 14*b* or between the third face 24*a* and the fourth face 24*b*, a U-shaped groove for fitting in the dielectric strip line portion by a predetermined depth may be formed either in the first planar portion 14 or second planar portion 24.

Figure 8:
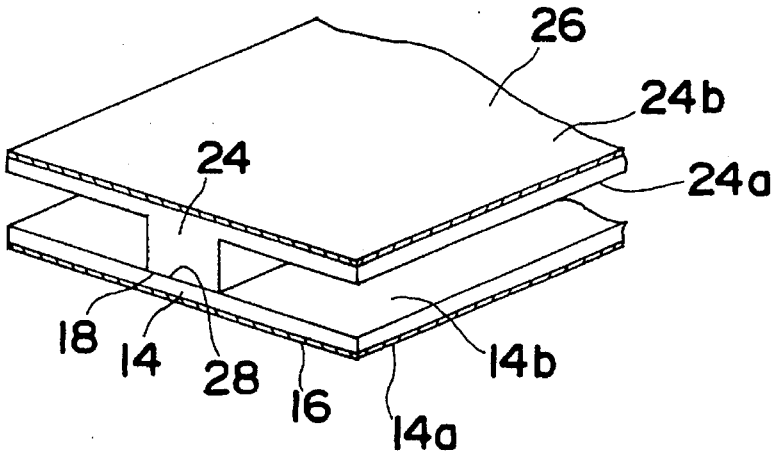
FIG. 8 is a perspective view showing the construction of a nonradiative dielectric waveguide according to a still another embodiment of the present invention.
Figure 9:
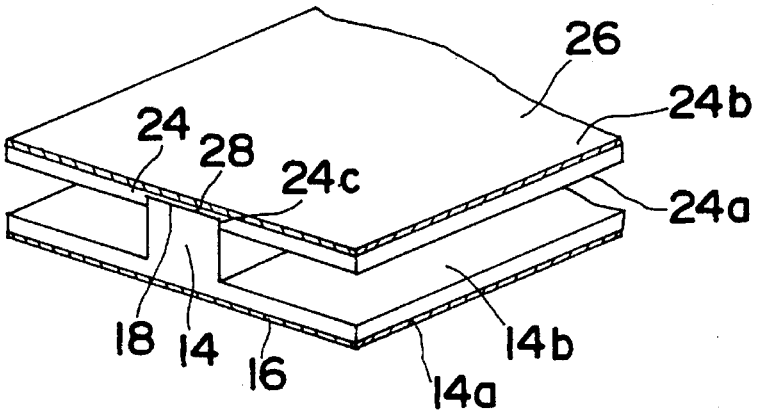
FIG. 9 is a perspective view showing the construction of a nonradiative dielectric waveguide according to a further embodiment of the present invention.
Figure 10:
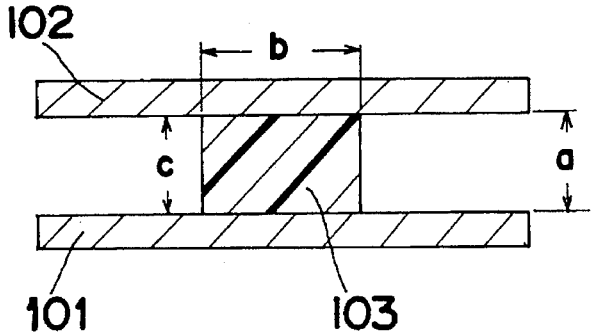
Fig. 10 PRIOR ART
FIG. 10 is a side sectional view showing one example of the construction of a conventional nonradiative dielectric waveguide.
Figure 11:
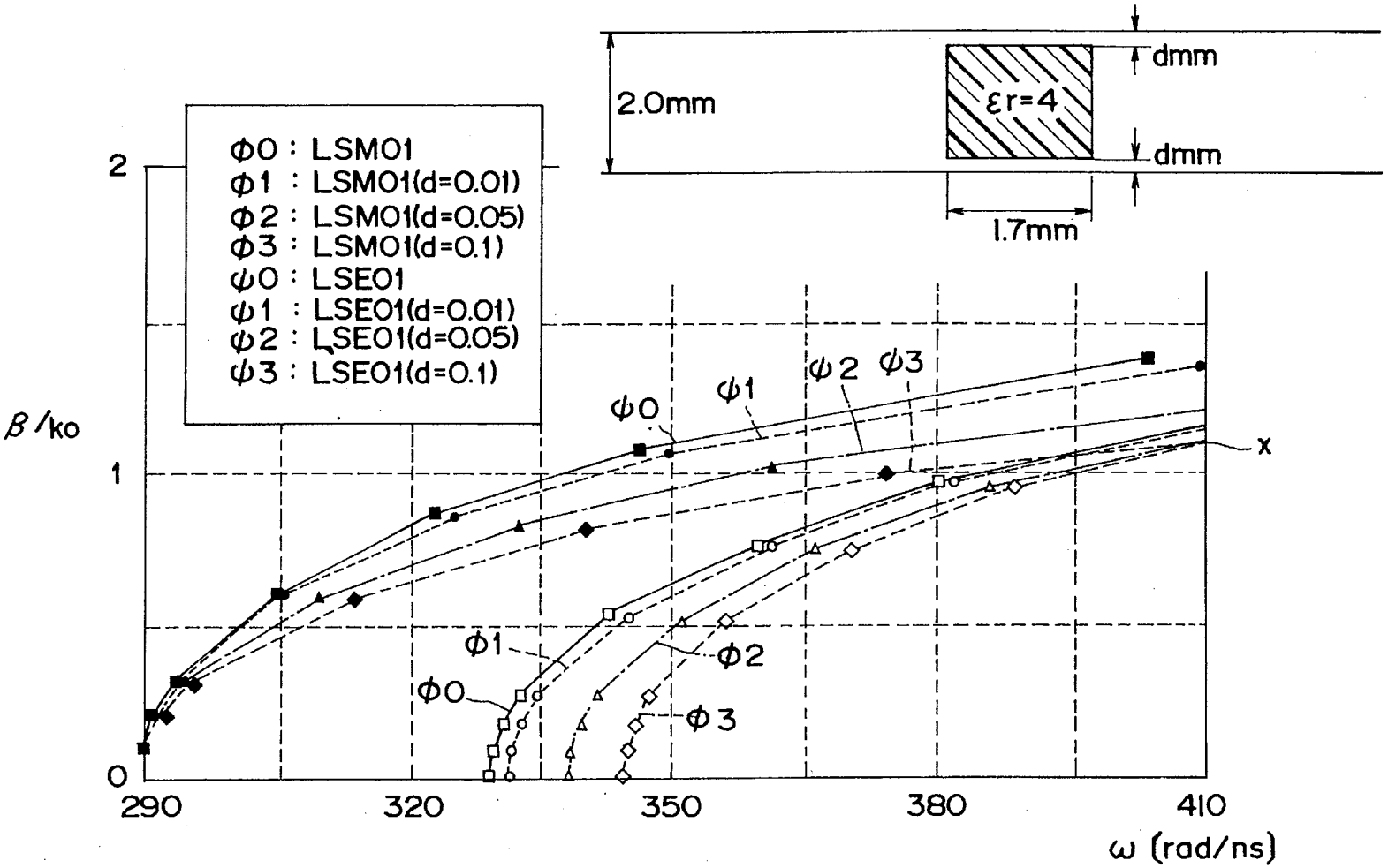
Fig. 11 PRIOR ART
FIG. 11 is a graphical diagram showing $\omega$-$\beta$/k0 curves in the case where side gaps are formed in the conventional nonradiative dielectric waveguide of FIG. 10.
Figure 12:
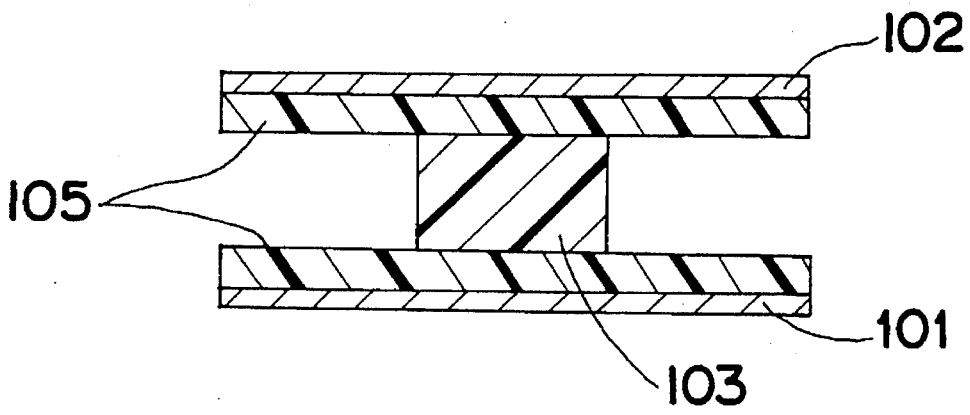
Fig. 12 PRIOR ART
FIG. 12 is a side sectional view showing another example of the construction of a conventional nonradiative dielectric waveguide.
Figure 13:
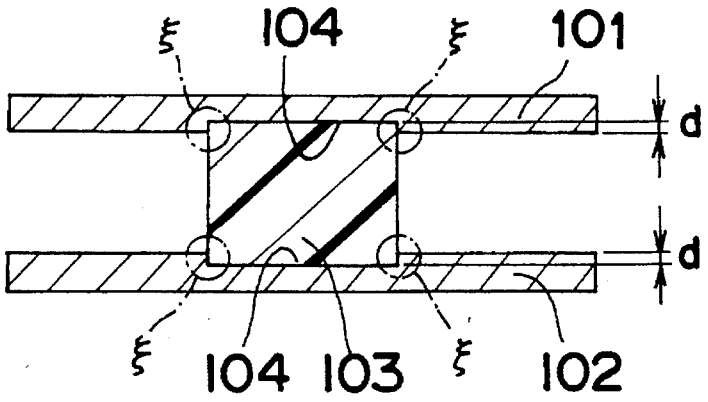
Fig. 13 PRIOR ART
FIG. 13 is a side sectional view showing still another example of the construction of a conventional nonradiative dielectric waveguide.
Figure 14:
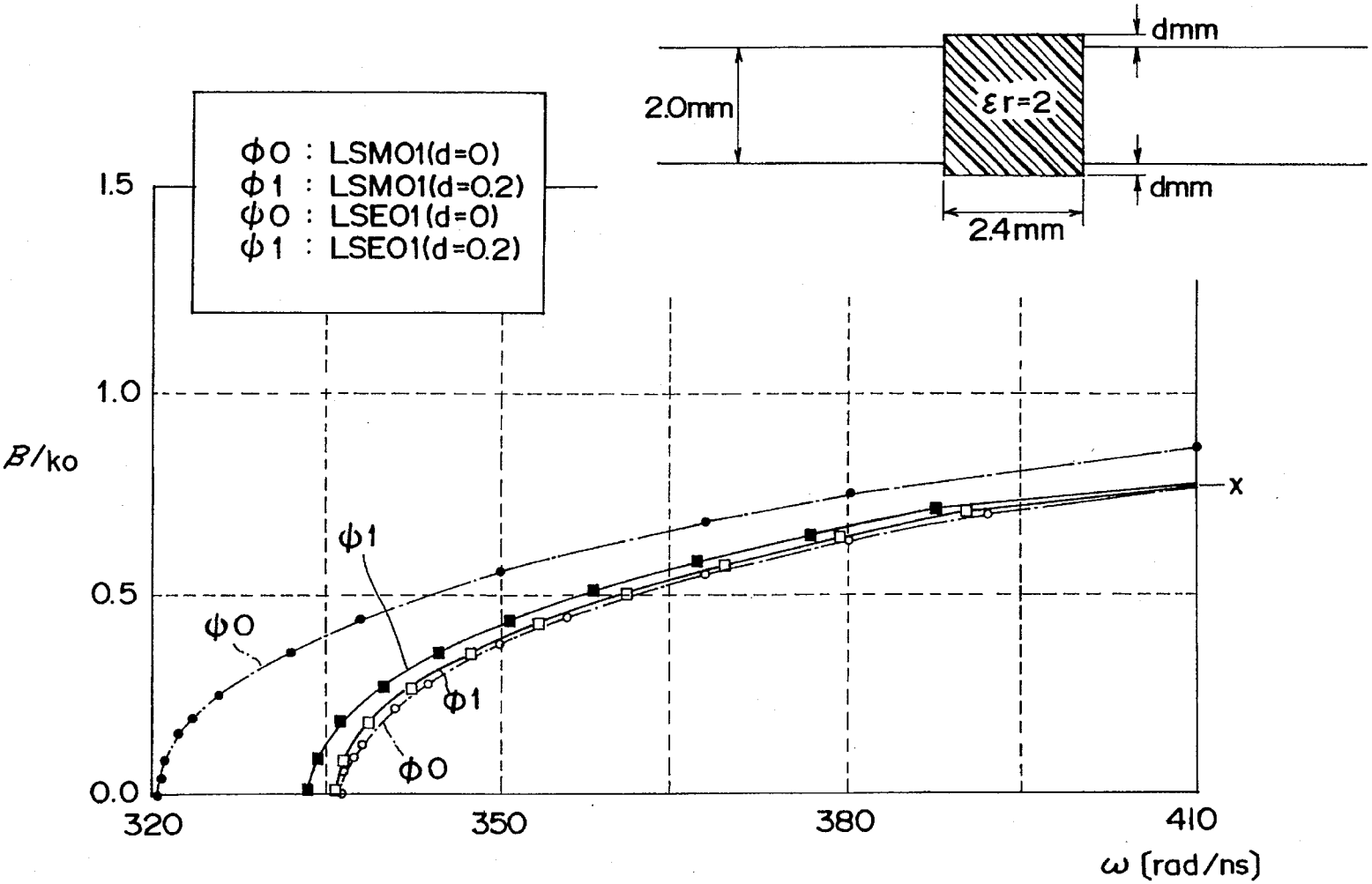
Fig. 14 PRIOR ART
FIG. 14 is a graphical diagram showing $\omega$-$\beta$/k0 curves in the conventional nonradiative dielectric waveguide of FIG. 13.
Figure 15:
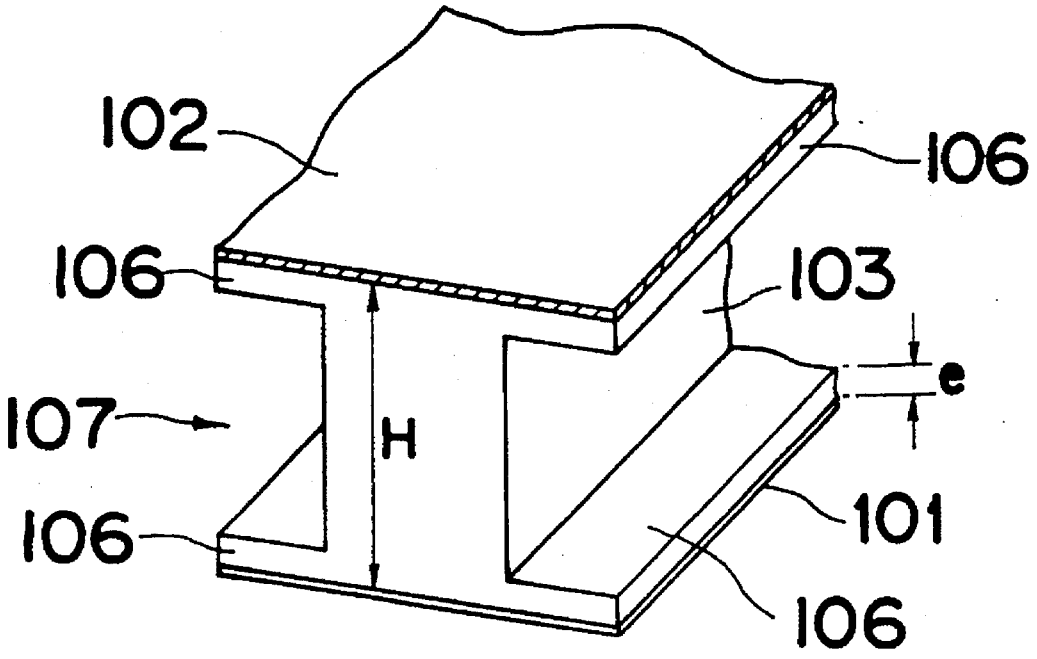
Fig. 15 PRIOR ART
FIG. 15 is a perspective view showing the construction of a still another conventional nonradiative dielectric waveguide.

FIG. 8 shows a further embodiment in which a dielectric strip line portion is formed by outwardly protruding part of the second planar portion 24, and the abutting faces 18 and 28 are adapted to be located on the second face 14*b*, while FIG. 9 shows a still further embodiment in which a dielectric strip line portion is formed by protruding part of the first planar portion 14, and the abutting faces 18 and 28 are adapted to be located between the second face 24*a* and the fourth face 24*b*, with a U-shaped groove 24*c* being formed in the second planar portion 24 for receiving the dielectric strip line portion.

As is seen from the foregoing description, according to the first aspect of the present invention, since the first and second dielectric strip line portions are disposed at the predetermined positions of the first and second dielectric units, positioning work may be dispensed with, and since the conductor electrodes are formed in close contact with the first and second dielectric units, inserting work of the first and second dielectric strip line portions becomes unnecessary for improved productivity. Moreover, since a larger contact area between the first and second strip line portions, first and second planar portions and both of the conductor electrodes is available, the first and second dielectric strip line portions are not positionally deviated by the mechanical vibrations and impacts, etc., and thus, initial characteristics can be maintained for improvement of reliability. Furthermore, formation of side gaps between the first and second dielectric strip line portions and conductor electrodes is advantageously eliminated, thereby to prevent deterioration of transmission characteristics resulting from such side gaps. Additionally, owing to the structure that is divided into the first and second housings, disposition of circuit components between the conductor electrodes may be facilitated for formation into an integrated circuit.

In another aspect of the present invention, since the abutting faces of the first and second dielectric strip line portions are formed to be located generally at a central portion between both conductor electrodes, even when gaps are formed between the abutting faces of the first and second dielectric strip line, the nonradiative dielectric waveguide is free from the mode coupling, transmission loss, and deterioration of the transmission characteristics.

In a further aspect of the present invention, since it is so arranged to apply the honeycomb structure at the first and second planar portions, the thickness of the planar portions may be reduced, while maintaining the mechanical strength thereof, and moreover, the effective dielectric constants of the flat portions can be reduced for prevention of the mode coupling and improvement of the transmission characteristics.

In still another aspect of the present invention, according to the method of manufacturing the nonradiative dielectric waveguide of the present invention, in the process in which the pair of abutting faces are in a state of nonclose contact with each other, the abutting faces are adapted to closely contact each other after providing the circuit component between the second face of the first dielectric member and the third face of the second dielectric member, and therefore, disposition of the circuit component is facilitated, and the nonradiative dielectric waveguide formed into the integrated circuit can be readily manufactured.

Although the present invention has been fully described by way of example with reference to the accompanying drawings, it is to be noted here that various changes and modification s will be apparent to those skilled in the art. Therefore, unless otherwise such changes and modifications depart from the scope of the present invention, they should be construed as included therein.

What is claimed is:

1. A nonradiative dielectric waveguide comprising: a set of flat plate-like conductor electrodes disposed generally parallel to each other and dielectric units disposed between said conductor electrodes, with a distance between said conductor electrodes being smaller than half a wavelength of electromagnetic waves propagated along said dielectric units, a first housing and a second housing, said first housing including a first dielectric unit having a first planar portion and a first dielectric strip line portion integrally formed therewith and extending outwardly from said first planar portion at a predetermined position and by a predetermined height, with an abutting face of said first dielectric strip line portion generally parallel with said conductor electrodes one electrode of said conductor electrodes formed in close contact with a face of said first dielectric unit, at a side opposite to said abutting face, said second housing including a second dielectric unit having a second planar portion and a second dielectric strip line portion integrally formed therewith and extending outwardly from said second planar portion at a predetermined position and by a predetermined height, with an abutting face of said second dielectric strip line portion generally parallel with said conductor electrodes, and the other electrode of the conductor electrodes formed in close contact with a face of said second dielectric unit, at a side opposite to said abutting face, and said abutting face of said first dielectric strip line portion confronts said abutting face of said second strip line portion so that said first and second dielectric strip line portions cooperate to propagate electromagnetic waves.

2. A nonradiative dielectric waveguide as claimed in claim 1, wherein the first and second planar portions are of a honeycomb structure.

3. A nonradiative dielectric waveguide as claimed in claim 1, wherein said abutting faces of said first and second dielectric strip line portions are located generally at a central portion between said conductor electrodes.

4. A nonradiative dielectric waveguide as claimed in claim 3, wherein the first and second planar portions are of a honeycomb structure.

5. A method of manufacturing a nonradiative dielectric waveguide icluding a first dielectric member having a first face and a second face opposed to each other, a second dielectric member having a third face and a fourth face opposed to each other, with said third face being disposed to confront said second face of said first dielectric member through a predetermined distance, a dielectric strip line portion located between said first dielectric member and said second-dielectric member, said dielectric strip line portion includes integrally formed projecting parts of each of said first and second dielectric members, a first conductor electrode formed to closely contact said first face of said first dielectric member, and a second conductor electrode formed to closely contact said fourth face of said second dielectric member, and said first dielectric member and said second dielectric member having a pair of abutting faces extending along said dielectric strip line portion, said first and second dielectric members being formed into one unit at said dielectric strip line portion by close contact of said abutting faces, said manufacturing method comprising the steps of:

providing a circuit component between said second face of said first dielectric member and said third face of said second dielectric member in a process where said pair of abutting faces are not in a state of close contact, and thereafter closely contacting said pair of abutting faces with each other.

6. A nonradiative dielectric waveguide which comprises:

a first dielectric member having a first face and a second face opposed to each other, a second dielectric member having a third face and a fourth face opposed to each other, with said third face being disposed to confront said second face of said first dielectric member through a predetermined distance, a dielectric strip line portion located between said first dielectric member and said second-dielectric member said dielectric strip line portion includes integrally formed projecting parts of each of said first and second dielectric members, a first conductor electrode formed to closely contact said first face of said first dielectric member, and a second conductor electrode formed to closely contact said fourth face of said second dielectric member, said first dielectric member and said second dielectric member having a pair of abutting faces extending along said dielectric strip line portion, said first and second dielectric members being formed into one unit at said dielectric strip line portion by close contact of said abutting faces.

7. A nonradiative dielectric waveguide which comprises:

a first dielectric member having a first face and a second face opposed to each other, a second dielectric member having a third face and a fourth face opposed to each other, with said third face being disposed to confront said second face of said first dielectric member through a predetermined distance, a dielectric strip line portion located between said first dielectric member and said second-dielectric member, said dielectric strip line portion includes an integrally formed projecting part of said first dielectric member, a first conductor electrode formed to closely contact said first face of said first dielectric member, and a second conductor electrode formed to closely contact said fourth face of said second dielectric member, said first dielectric member and said second dielectric member having a pair of abutting faces extending along said dielectric strip line portion, said first and second dielectric members being formed into one unit at said dielectric strip line portion by close contact of said abutting faces.

8. A nonradiative dielectric waveguide which comprises:

a first dielectric member having a first face and a second face opposed to each other, a second dielectric member having a third face and a fourth face opposed to each other, with said third face being disposed to confront said second face of said first dielectric member through a predetermined distance, a dielectric strip line portion located between said first dielectric member and said second-dielectric member, said dielectric strip line portion includes an integrally formed projecting part of said second dielectric member, a first conductor electrode formed to closely contact said first face of said first dielectric member, and a second conductor electrode formed to closely contact said fourth face of said second dielectric member, said first dielectric member and said second dielectric member having a pair of abutting faces extending along said dielectric strip line portion, and first and second dielectric members being formed into one unit at said dielectric strip line portion by close contact of said abutting faces.

9. A method of manufacturing a nonradiative dielectric waveguide including a first dielectric member having a first face and a second face opposed to each other, a second dielectric member having a third face and a fourth face opposed to each other, with said third face being disposed to confront said second face of said first dielectric member through a predetermined distance, a dielectric strip line portion located between said first dielectric member and said second-dielectric member, said dielectric strip line portion includes an integrally formed projecting part of said first dielectric member, a first conductor electrode formed to closely contact said first face of said first dielectric member, and a second conductor electrode formed to closely contact said fourth face of said second dielectric member, and said first dielectric member and said second dielectric member having a pair of abutting faces extending along said dielectric strip line portion, said first and second dielectric members being formed into one unit at said dielectric strip line portion by close contact of said abutting faces, said manufacturing method comprising the steps of providing a circuit component between said second face of said first dielectric member, and said third face of said second dielectric member in a process where said pair of abutting faces are not in a state of close contact, and thereafter closely contacting said pair of abutting faces with each other.

10. A method of manufacturing a nonradiative dielectric waveguide including a first dielectric member having a first face and a second face opposed to each other, a second dielectric member having a third face and a fourth face opposed to each other with said third face being disposed to confront said second face of said first dielectric member through a predetermined distance, a dielectric strip line portion located between said first dielectric member and said second-dielectric member, said dielectric strip line portion includes an integrally formed projecting part of said second dielectric member, a first conductor electrode formed to closely contact said first face of said first dielectric member, and a second conductor electrode formed to closely contact said fourth face of said second dielectric member, and said first dielectric member and said second dielectric member having a pair of abutting faces extending along said dielectric strip line portion, said first and second dielectric members being formed into one unit at said dielectric strip line portion by close contact of said abutting faces, said manufacturing method comprising the steps of providing a circuit component between said second face of said first dielectric member and said third face of said second dielectric member in a process where said pair of abutting faces are not in a state of close contact, and thereafter closely contacting said pair of abutting faces with each other.

* * * * *